United States Patent [19]

Schäfer et al.

[11] Patent Number: 4,594,021

[45] Date of Patent: Jun. 10, 1986

[54] MARKER BLOCK FOR DIVISIONS ON TRAFFICWAYS IN FORM OF AN OBLONG BEAM-LIKE BODY AND HAVING REFLECTIVE MEANS

[76] Inventors: Hartmut Schäfer, Oberbuschweg, 5000 Cologne 50; Franz Linder, Waldorferstrasse 7, 5000 Cologne 51, both of Fed. Rep. of Germany, D-5000

[21] Appl. No.: 603,130

[22] Filed: Apr. 23, 1984

[51] Int. Cl.[4] ..... E01F 13/00

[52] U.S. Cl. ..... 404/14; 404/6; 404/16

[58] Field of Search ..... 404/6–16, 404/32; 256/1, 13.1; 52/102, 103; 47/33

[56] References Cited

U.S. PATENT DOCUMENTS

| | | | |
|---|---|---|---|
| 2,794,375 | 6/1957 | DiFalco | 404/13 X |
| 3,179,009 | 4/1965 | Sheffield et al. | 404/12 X |
| 3,636,829 | 1/1972 | Palmer | 404/7 |
| 4,035,059 | 7/1977 | DeMaster | 404/6 X |
| 4,142,814 | 3/1979 | Sanchez | 256/1 X |
| 4,183,505 | 1/1980 | Maestri | 404/10 X |
| 4,428,320 | 1/1984 | Oplt et al. | 404/14 X |

FOREIGN PATENT DOCUMENTS

| | | | |
|---|---|---|---|
| 536999 | 4/1955 | Belgium | 404/12 |
| 710804 | 7/1966 | Italy | 256/13.1 |
| 355894 | 9/1931 | United Kingdom | 404/12 |

*Primary Examiner*—James A. Leppink
*Assistant Examiner*—John F. Letchford
*Attorney, Agent, or Firm*—Steele, Gould & Fried

[57] ABSTRACT

A marker block for divisions on trafficways is provided in form of an oblong prismatic body and includes a lower bottom surface, and two lateral faces. The block is made of an elastic material, preferably vulcanized rubber and especially recycled rubber, and has reflective means on at least one of the lateral faces especially a cat's-eye or a reflective foil. The block exhibits recesses in the form of passholes for screws, which allow a point by point fixation of said block.

17 Claims, 6 Drawing Figures

MARKER BLOCK FOR DIVISIONS ON TRAFFICWAYS IN FORM OF AN OBLONG BEAM-LIKE BODY AND HAVING REFLECTIVE MEANS

BACKGROUND OF THE INVENTION

1. Field of the Invention

The invention relates to a marker block for trafficways in form of an oblong, beam-like body, having a substantially constant cross-section over its length and having a lower bottom surface, and two lateral faces.

2. Description of the Prior Art

Marker blocks of this kind forming state of the art are used for delimiting routes, ways and other communications, traffic areas and green plots. They are usually made of concrete, but may be fabricated from another solid material having inherent stability, as for example natural stone. A typical embodiment of the marker block of the state of the art is the so called curbstone or a stone for delimiting lawns, which is used in the form of a straight block for rectilinear boundaries or in the form of a curved stone for curved borders in communications or for the laying-out of greens. Furthermore the marker blocks of the state of the art include all those high or low stones, which separate footways and bicycleways from nearby lanes for motorvehicles and line and delimit for instance traffic islands from other traffic zones.

All these known marker blocks are fixed at their lower, usually flat bottom or fixation surface and additionally with a lower part of at least one of their lateral faces in a bed, usually a bed of mortar, and are fixed permanently.

In this way typically only a part of their lateral faces, generally only one lateral face, is available for marking functions. The placing of the known marker block requires an excavation. When subsequently laying the known marker blocks on trafficways a part of the trafficway directly adjacent to the lateral faces has to be excavated and needs repair or filling later on. A drawback of the known marker blocks lies especially in the fact, that the subsequent addition to existing traffic areas affords a considerable amount of work, which is linked to high expense.

It is regarded as rather detrimental, that the known marker blocks are entirely stiff, they do not reduce tensions or forces if loaded for example by a wheel of a motorvehicle. This rigidity of the known marker block has the further disadvantage, that non-rectilinear delimitations either have to be realized with marker blocks specially made with the curvature formed therein as needed, which takes pains and is costly, or have to be assembled of rectilinear marker blocks in the form of a polygon. In the latter case severe problems arise for small radii of curvature, as acute corners are formed. This is especially the case for traffic islands.

Finally it is an disadvantage of the known marker blocks, that once they are placed, they cannot readily be non-destructively lifted up and be reused. Especially for those marking purposes, which are intended only for a short duration, the known marker blocks are thus detrimental.

SUMMARY OF THE INVENTION

Based on this the invention has the main object to avoid the disadvantages of the known marker blocks and to provide a marker block, which allows for a reduction of tension and forces, makes a universal use possible, can easily be seen and may be reused.

This object is achieved starting from the known marker block in that said block is made of an elastic material, preferably vulcanized rubber and especially recycled rubber, that said block has reflective means on at least one of the lateral faces, especially a cat's-eye or a reflective foil, and that said block exhibits recesses, especially through-holes for screws, which allow a fixation of said block at spaced points.

This marker block according to the invention is not only a replacement for the known marker blocks, but offers the possibility, to considerably improve the apprearance, recognizability and the delimiting effect of the marking device. The marker block according to the invention being made of elastic material, and especially recycled vulcanized rubber, can elastically comply with tensions and forces acting on it. The block thus cushions loads, damps hard impacts and thus protects human beings against hurts as well as motorvehicles against damages. Because of its fabrication out of an elastic material the marker block may be curved in its longitudinal direction so that it can easily be adapted to the curvature of a delimiting border and furtheron may be used in the case of differing levels, for example undulations, of the supporting surface on which a block is fixed. Rectilinearly formed marker blocks may consequently not only be used for straight running borders, but also for uniform or non-uniform curved delimitations to be marked. If the bends are too sharp, that is the radii of curvature too small, a second embodiment in form of a curved marker block is used, which due to its elasticity may additionally be bent in its longitudinal direction and thus covers all smaller radii of curvature existing in practice. By means of two marker blocks, a straight one and a curved one, all usually existing requirements for delimiting and marking lines can be performed continuously and without problems.

Due to the at least one reflective region on at least one of the lateral faces, the marker block is very easily seen especially during darkness. The reflective means may be realized as cat's-eye, reflective foils or the like. Thereby it is of advantage, especially in the case of cat's-eyes, that the marker block itself is made of an elastic material. When loads, especially motorvehicles, act on the reflective means, these may yield together with the material of the marker block, in this way a damaging of the reflective means is inhibited. Normally the reflective means reflect orthogonally to the longitudinal direction of the block. For motorvehicle traffic reflective means are advantageous which reflect the light in an acute angle to the longitudinal direction. Here gabled cat's-eyes or reflective means fixed to faces equivalently notched have proven successful.

Due to the attachment at spaced points in the region of the recesses, the marker block may be quickly fixed on a supporting surface, for example an asphalt layer, and may on the other hand be as quickly removed, whereby it is not destroyed but may be reused. The marker block has thus advantages for marking and delimitations, which are intended only for a given period of time, for example at building sites. Here it is favourable that the supporting surface, on which the marker block is placed and to which the block is fixed, is not really damaged and may be used after removal of the marker block. The same holds for the marking block itself, as indicated above.

The marker block may be accomodated as needed for its respective exploitation: for separating routes and lanes in motorvehicle traffic the cross section is preferably symmetrical, both lateral faces being equipped with reflective means. When used to delimit bicycle ways or lanes within a route, marker blocks may be used which have a considerably smaller cross-section as than those used for motorvehicle traffic. Furtheron in these cases only one lateral face needs reflective means. When used as crossbar or transversal bar especially at the beginning and the end of traffic abatements, the block has a more rounded profile, especially a flat, round marker block is advantageous. The reflection means signal the presence of the deliberately-placed obstruction to the driver, but the form and the shape of the marking block allow a moderate crossing of the obstruction. In this special application and this embodiment of a general advantage of the marker block of the invention become really apparent: as this marker block absorbs impacts and reduces forces acting on it, the block helps to diminish traffic noise.

In a preferred embodiment, the marker stone has a constant cross section over its total length and is consequently prismatic. Preferably its delimiting surfaces are planes and/or cylindric surfaces.

In a preferred embodiment the upper face runs parallel to the bottom or fixation surface and is smaller that the latter, the lateral faces being composed of an upper sloping face and a vertical face. In the region of the upper sloping face reflective means may preferably be attached, this means will be easily seen, as the sloping face more or less runs oblique to the viewing direction of a person.

Marker stones having a bow-like profile, especially a partly spherical, flat profile have proven successful as crossbars at the beginning or at the end of traffic abatement zones.

An embodiment in which the endfaces run perpendicular to the longitudinal direction is preferred. In this manner both endfaces are identical, the placing is made simpler, because this marker block according to the invention has identical endfaces. It is advantageous to provide grooves in the endfaces, which taper to a depth of zero at the upper surface. In this manner they can not be recognized, if two marker blocks are put together at their endfaces, which is the usual mounting. Triangular or similarly shaped connection pieces may be arranged in these grooves, these pieces cannot be detected or removed once the mounting is finished. In this way a positive interlocking of adjacent marker stones is reached.

It is advantageous to provide recesses for drainage at the bottom surface, these recesses appear in the form of inlets on both lateral faces and connect these faces. In this manner surface water may flow between the marker block and its supporting surface, as a consequence the drainage of the surfacewater is eased, puddles or pools, which may cause danger to the traffic or at least an annoyance, can no longer develop on one or both sides of the marker stone. Preferably a number of such draining recesses are provided over the total length of the marker stone, said length being typically betweel 0.1 and 2 meters.

It is preferred to provide a projection or a groove on the bottom fixation surface. In this manner the marker stone may be pressed on a guide rail, which was already provided or was posed especially for this purpose. In both cases a very precise course of the marking-line is obtained, especially in case of curvatures. Furtheron the mounting is simplified.

It is preferred to make the marker stone of vulcanized rubber material in form of granules, especially cubic granules. Besides this linear rubber materials are preferred for the manufacture of the marker stone, too, i.e. thin length of rubber, for instance cut in the form of fibers. By choosing a special rubber material or a mixture of different rubber particles are certain reduction of tensions and forces can be reached and adjusted.

The marker blocks or stones are fabricated in a special mold. Thereby it is advantageous to provide recesses on the lateral faces or in the upper surface, which serve for fixation of the reflective means, especially cat's-eyes or reflective foils. In this way the reflective means may be lodged in the recesses of the faces of the marker stone and do not project from its surface. A permanent mounting is obtained, an unwanted removal is rendered difficult.

Especially for marker stones for motorvehicle traffic it may be advantageous to reinforce a stone by an inner reinforcement. This may be done by usual reinforcement materials, especially plastic threads or mats.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENTS

Figure 1:
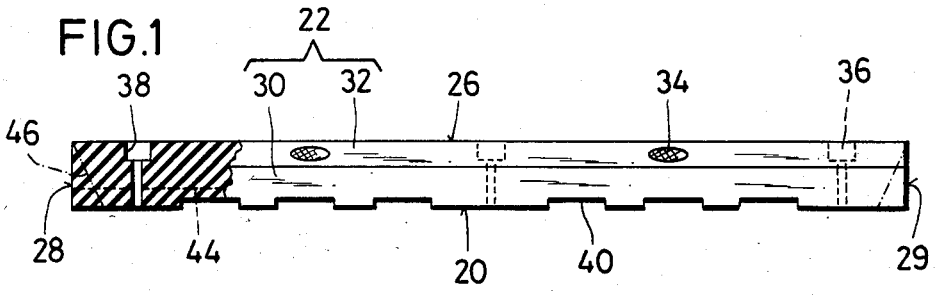
FIG. 1 is a side-view, partly in longitudinal section, of a marker stone having sloping faces and a symmetrical cross-section.

All marker blocks or stones shown are oblong, their length exceeds by far their height or their width. Consequently they have a beam-like, prismatic body having a constant cross-section over its total length. Each marker block has a lower fixation or bottom surface 20, which is planar in the embodiments shown, but may have a different form, a groove 21 (FIG. 5) or a projection 21' (FIG. 6) may be provided on this surface 20. As a rule the botton surface 20 is planar in normal cases. The bottom surface 20 flushly and completely rests on a supporting surface in the mounting condition, because the marker block is made of an elastic material. In this manner a good adhesion relative to the supporting surface is reached, so that especially under the action of laterally directed forces a displacement of the fixation surface 20 relative to the supporting surface is prevented. Generally it is not necessary to fully exclude such dislocations, but it is preferred to suppress them.

Furtheron the marker stone has two lateral faces 22, 24, an upper face 26 and two end faces 28, 29.

As indicated above the marker block is fabricated of an elastic material, especially a vulcanized rubber and preferably recycled rubber. The marker stone is made of solid material. The elasticity is chosen in such a way, that a reduction of forces and tensions of forty to sixty percent, preferably fifty percent in relation to a sandbed having a standard graining as a reference is reached. A reduction of tensions and thus the hardness of the material are adjusted according to the intended purpose of the marking block, a higher value of the hardness is chosen for traffic routes and areas of motorvehicles than in the case of applications on footways or bicycleways. The setting of the hardness and thus of the factor of reduction of forces is reached by an adequate selection of the size and form of the rubber particles or grains from which the marker stone is composed and by selecting their mutual connection by means of an adhesive. Used tires are cut into pieces of the size and form intended, the granules and/or shag-threads obtained are mixed with a suitable adhesive, the mixture is filled into a mold of the desired shape and solidifies to a prismatic, elastic block.

Both lateral faces 22, 24 are of identical form, the profile of the marker block according to the FIGS. 1 to 6 is mirror-symmetrical and constant over the entire length. Each lateral face 22, 24 consists of a lower vertical face 30 and a directly adjoining sloping face 32 in the upper region. As shown in the figures reflective means or regions 34 are provided on these sloping faces 32, in the embodiment shown the reflective means are cat's-eyes. These are flushly embedded into the material of the marker block. For this a recess (not shown) is provided, fixation fingers (not shown) on the backside of the cat's-eyes being inserted into these recesses. The fingers have clips or claws or a sawtooth-like shape in order to allow a permanent fixation. The number of the reflective means 34 is chosen in consideration of the intended purpose of the marker block, much more reflective means 34 than shown or reflective means having a larger area may be employed.

On a vertical bisecting line which is at the same time the plane of mirror-symmetry, a total of three through-holes 36 are provided which allow attachment at space point. They have enlargements 38 in the region of the upper face 26 being formed in such a way, that the head of a screw 37 inserted into the through-holes 36, especially a head of a polygonal shape, lies distinctly under the upper face 26, so that the head of the screw 37 does not protrude relative to the upper face 26, if the latter is resiliently depressed.

The marker block is preferably fixed by screws. For this purpose holes are drilled into the supporting surface prior to mounting, if the supporting underground shows sufficient stability, i.e. is in the form of concrete or asphalt. Dowels are inserted in known way into the drilled holes, which spread when the screw is tightened and permanently secure the screw. When tightening the screw the marker block is pressed with its entire bottom face 20 against the supporting face. In case of non cohesive subsoils, especially earth, an impregnated block of wood is embedded in the ground or a nail or pin of steel having an internal screw thread is driven into the subsoil.

The marker block has a total of six draining recesses 40 running oblique to its longitudinal direction and arranged between the through-holes 36 and spaced from these through-holes 36. In this manner a passage for water between the marker block and its lower fixation or bottom surface 20 is reached. The recesses 40 are to be seen on both lateral faces 22, 24 and connect these faces 22, 24. The draining recesses 40 preferably run orthogonally to the longitudinal direction and have the shape of a parallelepiped. Their width in the embodiment shown is seventy millimeters, their height is ten millimeters. They begin in a distance of seventy millimeters aside of a through-hole 36, respectively.

Figure 2:
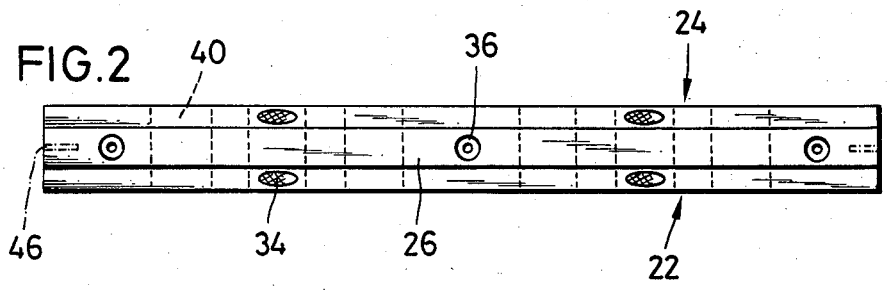
FIG. 2 is a top view on a marker block according to FIG. 1.
Figure 5:
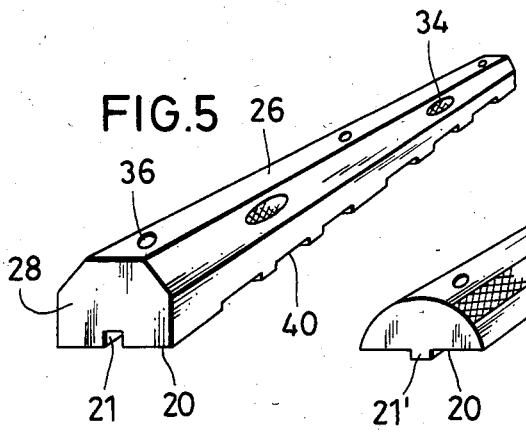
FIG. 5 is a perspective view of the marker block according to FIG. 1 and FIG. 2.
Figure 6:
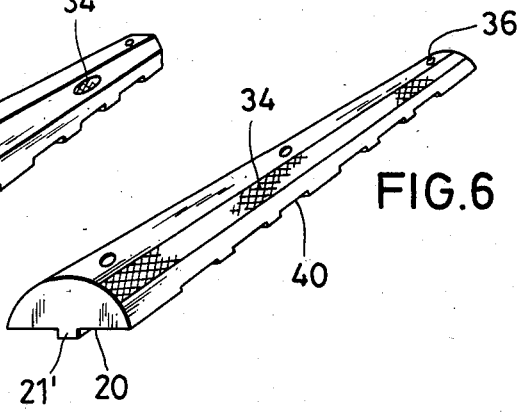
FIG. 6 is a perspective view of a marker block having a rounded, flat profile.

The marker block shown in the FIGS. 1, 2 and 5 has the following dimensions: the total length is one meter, the height is approx. eighty millimeters, the vertical faces 30 have a height of fifty millimeters, the sloping faces 32 have a vertical height of thirty millimeteres. The marker stone is hundred millimeters wide, its upper surface 26 is fifty millimeters wide.

In a preferred embodiment the enlargements 38 of the through-holes 36 are formed in such a way, that they may receive cat's-eyes. In this way the proper screws are fully covered and protected at the same time.

Figure 3:
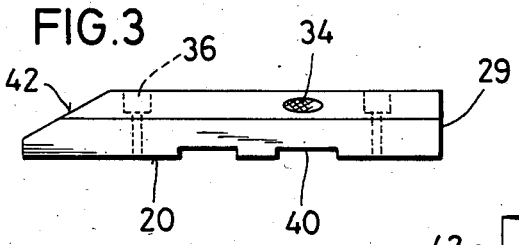
FIG. 3 is a side view of a marker block in accordance with FIG. 1 but in form of a first or last marker block of a row of blocks.
Figure 4:
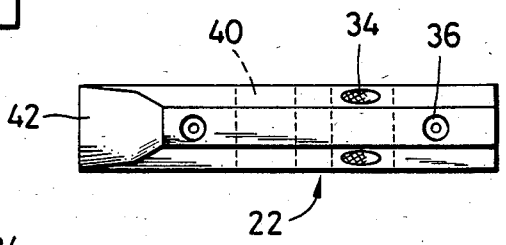
FIG. 4 is a top view of the block shown in FIG. 3.

In FIG. 3 and FIG. 4 a marker block in form of a first or an end piece is shown and has basically the same construction as the marker block already discussed. A difference to the latter lies in a sloping face 42 in the region of one end face 28, but not both ends faces. This sloping face 42 runs at an angle of about thirty degrees to the fixation or bottom surface 20 and is continued towards the bottom by a vertical part of the end face having a height of twenty-five millimeters.

In FIGS. 1 and 2 a triangular-shaped groove 46 is shown by a dash and dot line in both end faces 28. This groove 46 cannot be seen if two marker blocks are put together endwise. A triangular shape connection piece may be inserted into these grooves and provides a positive locking of adjacent blocks. The marker block of the embodiment shown in FIG. 6 has a mirror-symmetrical profile, too, but a flat rounded profile is possible. Rectangular reflective foils are inserted in the lateral faces 22 as reflective means 34 or are permanently fixed onto these lateral faces 22, 24. Besides this, there is no difference to the embodiments already discussed above. Through-holes 36 for screws are provided, too, the fixation of which is done point by point. An end piece or first piece having at one end a sloped or rounded end face and being like the embodiment shown in FIGS. 3 and 4 belongs to a realization of the embodiment shown in FIG. 6.

Instead of the preferred material of recycled rubber obtained by cutting up used tires or similar articles, another yielding material may be used for the production of the marker block. Plastics which allow a certain reduction of forces and are according non-resistant to deformation may preferably be used. Plastic foams, for example polyarethane foams having non-porous surfaces or are covered with an elastic surface layer may be taken into regard. This does not exclude use of elastic solid plastics like a soft polyvinylchloride.

In FIG. 1 a reinforcement layer 44 is embedded in the marker block. It is in the form of a net or a mat of threads or wires having tensile strength. Steel-cord layers like the ones used in tires may be employed as well as plastic thread mats like the ones used for reinforcing plastic foils.

Finally it is intended to stress again the multipurpose use of the marker block according to the invention: this marker block may (seen separately or in combination) be used as a dividing or separating block, as a curbstone, as a limiting or bordering stone and as an edging stone. The universal operational applicability in these muultiple ranges of applications saves costs in stock-keeping of different stones of the state of the art, which have specially to be made to meet the purpose they are intended for. Furtheron the marker block according to the invention has a low specific weight and consequently is easy to handle. The reduction of the tensions and forces of the marker block according to the invention may be set and adjusted according to the individual needs. Factors of reduction of forces and of loads ranging between forty and sixty percent, preferably fifty percent, related to a sandbed of standard graining, have proven successfully.

A sandbed of standard graining (according to DIN 18915 part 1) consists of dry grains of less than six millimeters grainsize without any admixtures of tuff or clay. The measurement of the reduction of forces and leads for such a sandbed is given in DIN 18196 part 3.3, and the result obtained is taken as hundred percent value for comparison with the elasticity of the marker block.

The reflective means 34 preferably are retroreflecting, i.e. the reflection is independent of the angle of incidence of the light to be reflected within an extended angle of incidence. Finally the marker blocks have proven successfully for separating the access lane and the departure lane of a super highway connections in order to avoid that a driver accesses an express motor way in the wrong direction.

What is claimed is:

1. A solid and resilient marker block over which other vehicles can pass for divisions on highways comprising:

an oblong beam-like body having a substantial and constant cross-section over its length, said marker block having a bottom fixation surface, two lateral faces, an upper face and two end faces;

said marker block being made of an elastic material consisting of solidly-molded linear recycled rubber pieces and a binder, and having a longitudinal reinforcmeent member embedded therein, the body having reflective means on at least one of the faces, the lateral faces having recesses for receiving said reflective means, the upper faces recesses and through-holes having enlargements to the bottom for receiving screws for point by point fixation of said block to an underlying surface, Said surface marker being flexible and capable of being curved in its longitudinal direction so as to be adapted to conform to a curvature of the highway and to conform to different levels of the highway, said marker being of a height over which vehicles can pass.

2. The marker block of claim 1 wherein the profile of the marker block is mirror-symmetrical.

3. The marker block of claim 1 wherein the said faces are planes and/or prtly cylindrical faces.

4. The marker block of claim 1 wherein said upper face runs parallel to the bottom or fixation surface and is smaller than said bottom or fixation surface, and end lateral face is composed of an upper sloping face and lower vertical face.

5. The marker block of claim 1 wherein the end faces run orthogonally to the bottom or fixation surface.

6. The marker block of claim 1 in the form of a first or end piece wherein said piece has one and only one exhibiting an upper sloping face running at an angle of twenty to fifty degrees to the fixation or bottom surface.

7. The marker block of claim 1 wherein at least one of the width and height is at least a hundred millimeters and at most three hundred millimeters.

8. The marker block of claim 1 wherein the block runs straight in longitudinal direction or shows a curvature in longitudinal direction.

9. The marker block of claim 1 wherein draining recesses are provided in the fixation or bottom face and link both lateral faces.

10. The marker block of claim 1 wherein at least one of a projection and a groove is provided in one of the fixation and bottom face.

11. The marker block of claim 1 wherein the block is made of a linear rubber material formed by shredding recycled automobile tires.

12. The marker block of claim 1 wherein the block is fabricated of rubber granules.

13. The marker block of claim 1 having a length of at least 0.1 meters and at the most 2 meters.

14. The marker block of claim 1 wherein passholes are arranged in the region of mid-profile, run orthogonally to the fixation or bottom surface, and have an enlargement at the upper surface.

15. The marker block of claim 1 wherein a groove is provided in the end faces, the groove tapering to a depth of zero at the upper face.

16. The marker block of claim 1 wherein its material shows a factor of reduction of tensions and forces of forty to sixty percent, relative to a sandbed of standard graining.

17. The marker block of claim 1 wherein the block is made of particles obtained by cutting up vulcanized rubber and of an adhesive bonding said particles.

* * * * *

UNITED STATES PATENT AND TRADEMARK OFFICE

CERTIFICATE OF CORRECTION

PATENT NO. : 4,594,021

DATED : June 10, 1986

INVENTOR(S) : Hartmut Schafer and Franz Linder

It is certified that error appears in the above-identified patent and that said Letters Patent is hereby corrected as shown below:

In the Abstract:

Column 4, line 9, "are certain reduction" should be --a certain reduction--;

In the Claims:

Column 8, line 6, "prtly" should be —partly--;

Column 8, line 9, "end lateral face" should be --each lateral face—.

Signed and Sealed this

Twenty-eighth Day of October, 1986

[SEAL]

*Attest:*

DONALD J. QUIGG

*Attesting Officer* *Commissioner of Patents and Trademarks*